US006595754B2

(12) United States Patent
Kuang

(10) Patent No.: US 6,595,754 B2
(45) Date of Patent: Jul. 22, 2003

(54) BLADE BRACKET CONNECTOR FOR CEILING FANS

(76) Inventor: Jing An Kuang, 100, Chanwan Road, Huicheng Town, Xinhui City, Guangdong (CN)

( * ) Notice: Subject to any disclaimer, the term of this patent is extended or adjusted under 35 U.S.C. 154(b) by 0 days.

(21) Appl. No.: 09/985,882

(22) Filed: Nov. 6, 2001

(65) Prior Publication Data

US 2002/0176781 A1 Nov. 28, 2002

(51) Int. Cl.[7] ..... F04D 29/34
(52) U.S. Cl. ..... 416/210 R; 416/244 R
(58) Field of Search ..... 416/206, 210 R, 416/244 R, 220 R, 220 A, 5

(56) References Cited

U.S. PATENT DOCUMENTS 1,479,895 A * 10/1922 Colby
3,799,699 A * 3/1974 Master et al. ..... 416/206
4,140,435 A * 2/1979 Huber ..... 416/206
4,396,352 A * 8/1983 Pearce ..... 416/206
4,565,494 A * 1/1986 Dinger ..... 416/206
5,180,284 A * 1/1993 Monrose, III et al. .. 416/204 R
6,171,059 B1 * 1/2001 Bucher et al. ..... 416/210 R
6,336,792 B1 * 1/2002 Bucher et al. ..... 416/210 R

OTHER PUBLICATIONS

Catalogue Advertisement for InstaLoc Revolutionary Ceiling Fan Installation System by Westinghouse, Jul. 2001.

* cited by examiner

*Primary Examiner*—Edward K. Look
*Assistant Examiner*—James M McAleenan
(74) *Attorney, Agent, or Firm*—Nixon Peabody LLP; Jeffrey L. Costellia

(57) ABSTRACT

A blade bracket to releasably connect a blade of a ceiling fan to the rotor, the blade bracket comprising a mount adapted for attachment to the rotor and a blade support securable to the blade and releasably attachable to the mount, the mount comprising means to permit securable attachment to the rotor at one end, and at another end, a sleeve having an entrance and a base, the blade support comprising, at one end, means for securing a fan blade thereto and at another end thereof a neck which is releasably seatable into the mount sleeve through its entrance, and a lock mechanically associated with the mount and adjustable when the neck is seated in the sleeve to lock securely said neck in the sleeve, with the fan blade in proper orientation, for operation of the fan.

8 Claims, 3 Drawing Sheets

BLADE BRACKET CONNECTOR FOR CEILING FANS

FIELD OF THE INVENTION

The present invention relates to a novel blade bracket connector for ceiling fans, and more particularly to a blade bracket connector which releasably connects the fan blade to the rotor.

BACKGROUND OF THE INVENTION

Ceiling fans are normally connected to a motorized rotor by means of a blade bracket connector, one end of which is secured to the rotor, and the other end of which is attached to a fan blade. Because of the size and bulkiness of ceiling fans, they are delivered from a factory to a customer or to a store, for sale to a customer, in a disassembled form, with the blade brackets secured to the rotor and the fan blades usually disconnected from the blade brackets. The customer must connect each blade to a blade bracket connector by means of screws. This is a laborious and time consuming task.

In order to facilitate the task of mounting the fan blades to the rotor, blade bracket connectors have been developed which are secured at the factory to the blades, but which are shipped disasembled from the rotor to be assembled by the customer by means of a spring lock mechanism associated with the hub on the motor. The added length of the combination of the preassembled blade bracket and fan blade adds significantly to the shipping volume of each fan, increasing that volume by as much as fifteen percent, resulting in increased shipping costs and hence increased price to the consumer of such fans.

Another approach, in order to facilitate customer installation while at the same time attempting to reduce the shipping volume of each fan unit from the factory, has been to hinge the fan blades to the motor hub. The hinged construction of such fans does not provide as great stability as a ceiling fan having a conventional blade bracket construction, and still results in excess shipping volume of the units.

Yet another approach to easier assembly has been to provide blade brackets secured to the hub on the motor, with upstanding spaced projections over which corresponding aligned keyhole slots on the fan blades are placed. The blades are then outwardly moved to secure the projections in the narrower parts of the keyhole slots. Even when the fan blades are thus fixed in position, it is extremely difficult to avoid play on the blades, and vibration of the blades with respect to the blade brackets.

SUMMARY OF THE INVENTION

It is thus an object of the present invention to provide a construction of ceiling fan in which the blade bracket, blade and fan motor can all be largely assembled at the factory, and shipped out in a relatively small shipping volume per fan unit. It is a further object to provide such a construction which can be easily assembled by a customer and, when assembled, provide more rigid and stable construction and operation than these prior constructions.

In accordance with the present invention there is provided a blade bracket to releasably connect a blade of a ceiling fan to the rotor, the blade bracket comprising a mount adapted for attachment to the rotor and a blade support securable to the blade and releasably attachable to the mount. The mount comprises, at one end, means to permit securable attachment to the rotor. The blade support comprises, at one end, means for securing a fan blade thereto. At their other ends, the mount and blade support are provided with interlocking securing means releasably and securably to lock the mount and blade support together, with the fan blade in proper orientation, for operation of the fan.

In a preferred embodiment of the present invention, the mount comprises, at its other end, a sleeve having an entrance and a base, and the blade support comprises, at its other end, a neck which is releasably seatable into the mount sleeve through its entrance. A lock means is mechanically associated with the mount. This lock means is adjustable when the neck in seated in the sleeve to lock securely the neck in the sleeve, with the fan blade in proper orientation, for operation of the fan.

In yet another preferred embodiment of the present invention, the lock means comprises a carriage rotatably seated at the base of the sleeve to rotate between a receiving/locking position and a seating alignment position. The carriage is provided with a bearing surface and a slot in that bearing surface facing the base of the sleeve, and means to enable a person to move it between these two positions. A free end of the neck of the blade support has a protrusion with ears outwardly extending beyond sides of the neck to mateably fit into said slot in the carriage when the carriage is in the receiving/locking position and cause the neck to turn simultaneously as the carriage is then turned to seating alignment position. Slots are positioned in the sides of the sleeve, at its base, to mateably receive the locked ears when carried to seating alignment position by the carriage and the neck is then moved outwardly with respect to the sleeve. The bearing surface bears against the protrusion and securely locks the ears in the sleeve slots against dislodgment when the carriage is rotated back to receiving/locking position. The interior walls of the sleeve, is provided with opposed, ear-receiving slots along its length, these slots aligned with the slot in the bearing surface of the carriage when the carriage is in receiving/locking position so that the protrusion can be received in the bearing surface slot of the carriage when the neck is fully inserted in the sleeve.

The blade bracket, in accordance with the present invention, by permitting its blade support portion to be secured to the fan blade at the factory, avoids the time and inconvenience of customer assembly which has previously been a major problem with most types of ceiling fan constructions. Yet, by essentially splitting the blade bracket into two parts which can be assembled to provide a rigid and stable blade bracket unit, optimum savings in shipping volumes for ceiling fans having blade brackets of this construction can be realized.

BRIEF DESCRIPTION OF THE DRAWINGS

These and other advantages of the invention will become apparent upon reading the following detailed description and upon referring to the drawings in which.

Figure 1:
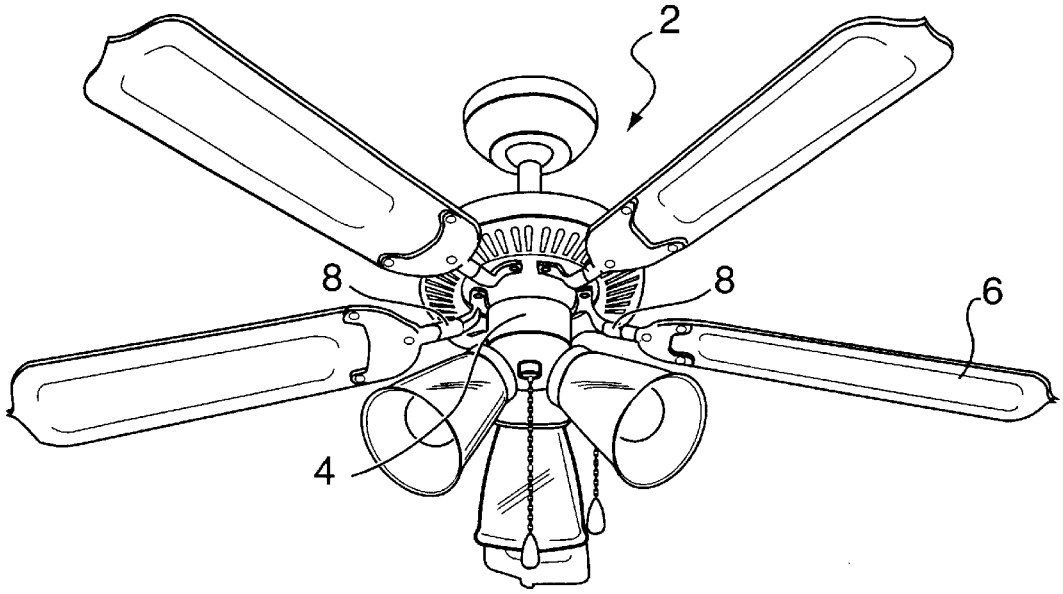
FIG. 1 is a perspective view of a fan carrying a plurality of blade bracket connectors in accordance with the present invention.

While the invention will be described in conjunction with an illustrated embodiment, it will be understood that it is not intended to limit the invention to such an embodiment. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Figure 2:
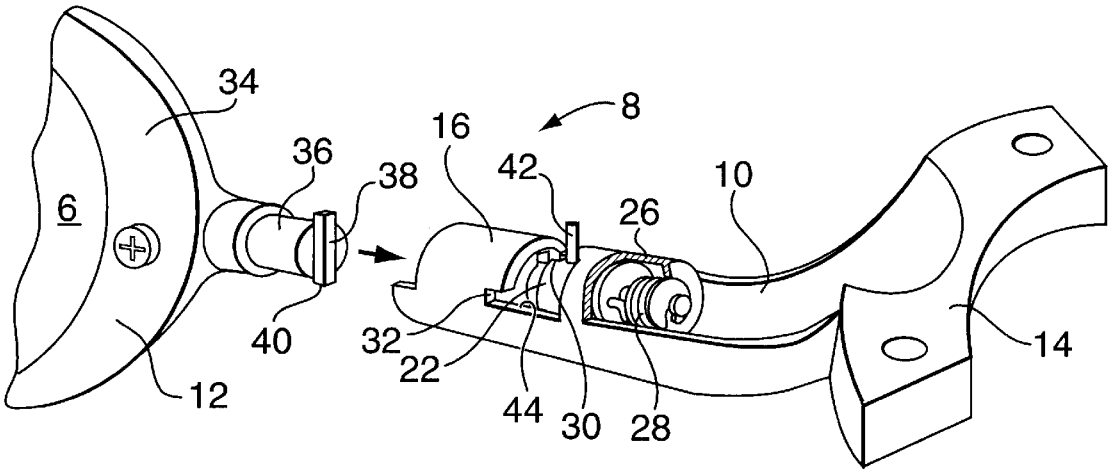
FIG. 2 is a perspective view in partial section of a blade bracket connector according to the present invention, with the mount ready for coupling of its blade support and mount components with the carriage in receiving/locking position.

Turning to FIG. 1, there is illustrated a fan (2) having a rotor hub (4) to which blades (6) are secured by means of blade brackets (8) in accordance with the present invention. As can be seen in FIG. 2, each blade bracket (8) is composed of two parts, a mount (10) which is preferably factory-secured to rotor hub at one end to rotor hub (4), and a blade support (12) which is again preferably secured at the factory to a corresponding blade (6). Mount (10) and blade support (12) are securely releasably attachable with each other in a manner which will be described in more detail subsequently, to provide a rigid and stable blade bracket operation during use of fan (2).

To accomplish this end, mount (10) is provided with a conventional flange (14) for securing to rotor hub (4). At its other end, mount (10) is provided with a sleeve (16), of circular cross-section, having a central receptacle (18) having generally cylindrical interior walls as illustrated. Slots (20), extending the length of receptacle (18), are provided in opposite sides of the inner walls of receptacle (18).

Figure 3:
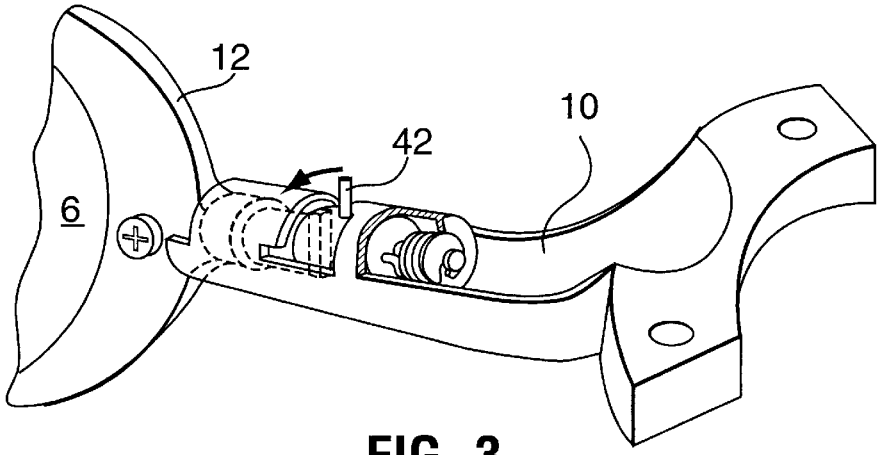
FIG. 3 is a perspective view similar the FIG. 2 but with the blade support neck inserted into the mount sleeve.
Figure 4:
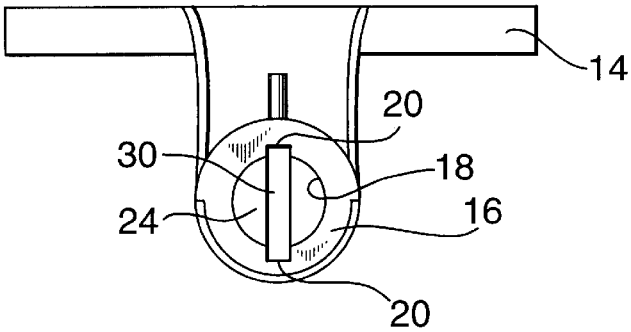
FIG. 4 is a front view of the mount of FIGS. 1 and 2.
Figure 5:
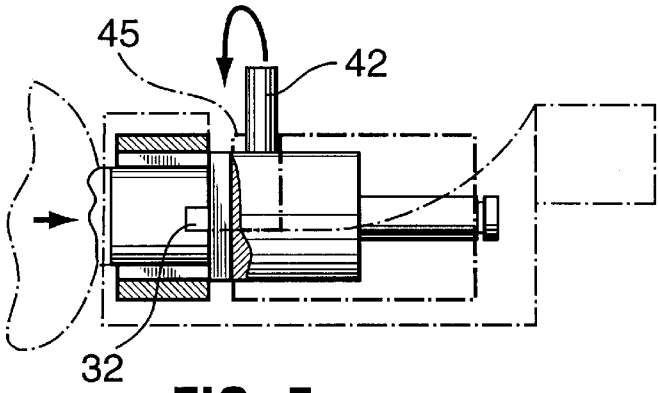
FIGS. 5, 6, 7 and 8 are schematic side views illustrating the various positions and movements of the carriage (2) during the securing of the blade support within the mount receptacle.
Figure 6:
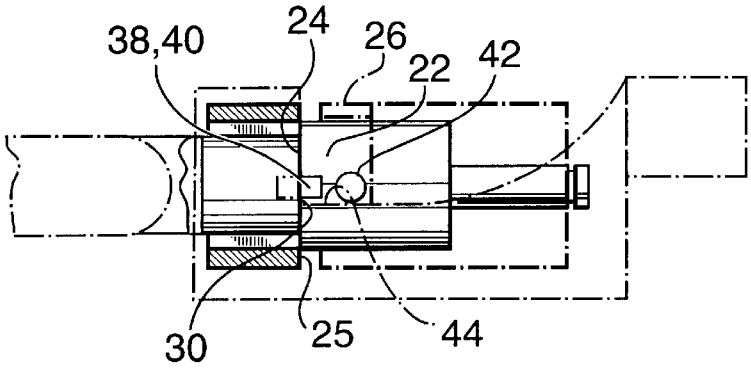

At the bottom of sleeve (16), is a carriage (22), again of circular cross-section. Carriage (22) has a bearing surface (24) immediately adjacent the back (25) of sleeve (16). Carriage (22) is held between back (25) of sleeve (16) and a backing seat (26) (shown in partial section in FIGS. 2 and 3), and permitted to turn about a quarter revolution between a receiving/locking position as illustrated in FIG. 5, and a seating alignment position illustrated in FIG. 6. Torsion spring (28) urges carriage (22) towards normal, receiving/locking position. This torsion spring (28) is secured at one end to the back of carriage (22) and the other end to a portion of backing seat of (26). A linear slot (30) (FIG. 4) is provided in carriage bearing surface (24), this slot aligned with receptacle slots (20) of sleeve (16) when carriage (22) is in receiving locking position. At a 90° orientation to slots (20) in sleeve receptacle (18), and located at the back of receptacle (18) are a pair of opposed slots 32 formed through the sleeve wall, the function of which will be described in more detail subsequently.

Cooperating with mount (10) is blade support (12), one end of which has a conventional flange (34) to be secured, in a conventional manner to fan blade (6). At the other end of flange (34) is a neck (36), of circular cross-section, to be mateably received in receptacle (18) of sleeve (16). At the far end of neck (36) is a linear projection (38) having ears (40) laterally extending beyond the sides of neck (36) as illustrated.

To assemble mount (10) and blade support (12), to provide a rigid and stable blade operation when the fan is running, the steps of locking neck 36 within sleeve (20) are illustrated schematically in FIGS. 5, 6, 7 and 8. In particular, neck (36) of blade support (12) is inserted in sleeve receptacle (18), with ears (40) being snuggly but slidably received in slots (20). When neck (36) has been fully inserted in receptacle (18), projection (38) with its ears (40) is seated in slot (30) of carriage (22), that carriage being in its receiving/locking position as illustrated in FIG. 5.

Carriage (22), by means of pin handle (42) is then rotated 90° in a clockwise direction, (FIG. 6) against the urging of spring (28), rotating blade support (12), neck (36) and projection (38) with it, until pin handle (42) meets stop (44), at which point carriage (22) and its slot (30) are in seating alignment position. In this position, ears (40) of neck (36) are aligned with side slots (32) in the back end of sleeve (16).

Figure 7:
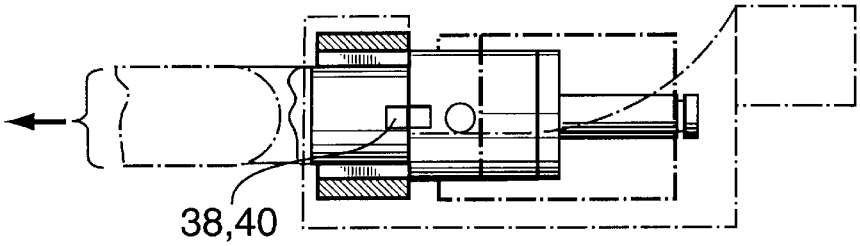

With the blade support (12) in this orientation with respect to mount (10), blade support (12) is then moved slightly outwardly, with respect to receptacle (18), so that ears (40) become seatably engaged in side slots (32) in (FIG. 7).

Figure 8:
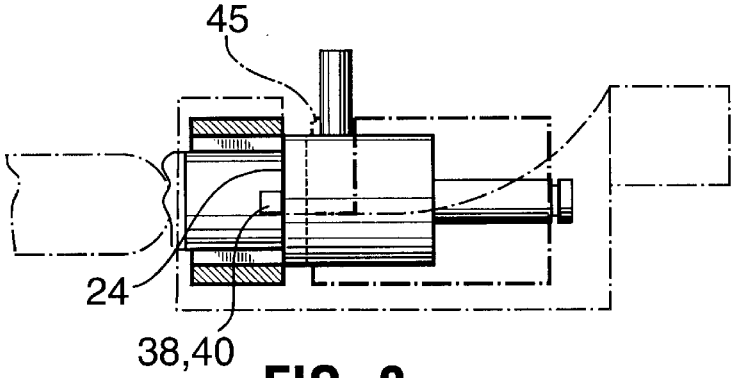

With projection (38) no longer being carried in slot (30) of carriage (22), carriage (22) is free then to swing back to its original, receiving/locking position under the urging of torsion spring (28) (FIG. 8). An edge portion (45) of backing seat (26) acts as a stop for pin handle (42), when it has returned to receiving/locking position, to ensure that it goes only to that position and not beyond. In this position, the front surface (24) of carriage (22) bears against projection (38), to firmly and securely hold ears (40) in their corresponding side slots (32). The fan blade (6) is then in proper orientation, and securely fastened through blade bracket (8), to rotor hub (4) for operation of the fan.

Blade bracket (8) may be readily disassembled by reversing the steps of FIGS. 5 to 8.

The construction of blade bracket according to the present invention has many advantages, including ease of construction, more rigid and stable operation of a fan incorporating such blade brackets, and cutting down on box space, from the factory, when comparing it to prior art devices.

Thus, it is apparent that there has been provided in accordance with the invention a blade bracket connector for ceiling fans that fully satisfies the objects, aims and advantages set forth above. While the invention has been described in conjunction with an illustrated embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

I claim:

1. A blade bracket to releasably connect a blade of a ceiling fan to the rotor, the blade bracket comprising a mount adapted for attachment to the rotor and a blade support securable to the blade and releasably attachable to the mount, the mount comprising at one end, means to permit securable attachment to the rotor, and the blade support comprising at one end, means for securing a fan blade thereto, there being provided, at the other end of the mount, a sleeve having an entrance and a base, and at the other end of the blade support, a neck which is releasably seatable into said mount sleeve through its entrance, and lock means mechanically associated with the mount and adjustable table when said neck is seated in said sleeve to lock securely but releasably said neck in said sleeve, with the fan blade in proper orientation, for operation of the fan, the lock means comprising a carriage rotatably seated at the base of the sleeve to rotate between a receiving/locking position and a seating alignment position, the carriage provided with a bearing surface and a slot in said bearing surface facing the base of the sleeve, and means to enable a person to move ft between said two positions, a free end of the neck of the blade support having a protrusion with ears outwardly extending beyond sides of the neck to mateably fit into said slot in the carriage when the carriage is in the receiving/locating position and cause the neck to turn simultaneously as the carriage is then turned to seating alignment position, slots positioned in the sides of the sleeve, at its base, to mateably receive the locked ears when carried to seating alignment position by the carriage and the neck is then moved outwardly with respect to the sleeve, the bearing surface bear against the protrusion and securely lock the ears in the sleeves slots against dislodgment hen the carriage is rotated back to receiving/locking position, an interior wall of the sleeve provided with ear-receiving slots along its length, the slots aligned with the slot in the bearing surface of the carriage when the carriage is in receiving slot/locking position so the protrusion can be received in the bearing surface slot of the carriage when the neck is fully inserted in the sleeve.

2. A blade bracket according to claim 1, wherein the carriage is normally biased towards receiving/locking.

3. A blade bracket according to claim 2, wherein the carriage is spring biased towards receiving/locking position.

4. A blade bracket according to claim 2, wherein a pin handle is fixed to the carriage and upwardly extends therefrom, and wherein stops are provided on the mount to restrict the movement of the carriage between receiving/locking position and seating alignment position.

5. A blade bracket according to claim 1, wherein the carriage, receptacle and neck are generally of circular cross-section.

6. A ceiling fan comprising a rotor and fan blades, the fan blades being secured to the rotor by means of blade brackets according to claim 1.

7. A ceiling fan comprising a rotor and fan blades, the fan blades being secured to the rotor by means of blade brackets according to claim 1.

8. A ceiling fan comprising a rotor and fan blades, the fan blades being secured to the rotor by means of blade brackets according to claim 1.

* * * * *